United States Patent [19]

Steiner

[11] Patent Number: 4,498,501

[45] Date of Patent: Feb. 12, 1985

[54] MULTIPLE LONGITUDINAL TRAVERSING SHED WEAVING MACHINE CONTAINING A WEAVING ROTOR

[75] Inventor: Alois Steiner, Rieden, Switzerland

[73] Assignee: Sulzer-Rüti Machinery Works Ltd., Rüti, Switzerland

[21] Appl. No.: 555,622

[22] Filed: Nov. 28, 1983

[30] Foreign Application Priority Data

Dec. 14, 1982 [CH] Switzerland ..... 7264/82

[51] Int. Cl.[3] ..... D03D 41/00; D03C 13/00

[52] U.S. Cl. ..... 139/28

[58] Field of Search ..... 139/11 A, 11 R, 28

[56] References Cited

U.S. PATENT DOCUMENTS 3,848,642 11/1974 Steiner ..... 139/28

4,291,729 9/1981 Steiner ..... 139/28

FOREIGN PATENT DOCUMENTS 2072719 10/1981 United Kingdom ..... 139/11 A

*Primary Examiner*—Henry S. Jaudon

*Attorney, Agent, or Firm*—Werner W. Kleeman

[57] ABSTRACT

At the weaving rotor there are arranged in alternating fashion in respect of a predetermined direction of rotation thereof beat-up combs for the weft threads and guide combs containing shed retaining elements for the upper shed position of the warp threads. In the running direction of the warp threads control means are provided in front of the weaving rotor for laterally deflecting and selectively allocating each warp thread to a shed retaining element. Each beat-up comb and each guide comb alternatingly includes first and second beat-up lamellae and first and second guide lamellae, respectively. Compared to the first beat-up and guide lamellae, the second beat-up lamellae and second guide lamellae each contain a recess at the location of the lamellae combs which first immerse into the warp threads during rotational movement of the weaving rotor. The lateral deflection of the warp threads due to the control means reaches a maximum after the immersion of either the first beat-up lamellae or the first guide lamellae. The warp threads are thus reliably introduced even with high warp thread densities and no warp introduction or threading errors can occur due to warp threads which skip and enter an adjacent tube.

12 Claims, 4 Drawing Figures

MULTIPLE LONGITUDINAL TRAVERSING SHED WEAVING MACHINE CONTAINING A WEAVING ROTOR

CROSS REFERENCES TO RELATED APPLICATIONS

This application is related to (i) the commonly assigned, copending U.S. application Ser. No. 06/483,526, filed Apr. 11, 1983, entitled "MULTIPLE LONGITUDINAL TRAVERSING SHED WEAVING APPARATUS"; (ii) the commonly assigned, copending U.S. application Ser. No. 06/483,527, filed Apr. 11, 1983, entitled "LAMELLAE COMB FOR WEAVING APPARATUS, PARTICULARLY FOR A WEAVING ROTOR IN A MULTIPLE LONGITUDINAL TRAVERSING SHED WEAVING LOOM, AND METHOD FOR MANUFACTURING THE SAME"; and (iii) the commonly assigned, copending U.S. application Ser. No. 06/555,592, filed Nov. 28, 1983, entitled "MULTIPLE LONGITUDINAL TRAVERSING SHED WEAVING MACHINE CONTAINING A WEAVING ROTOR".

BACKGROUND OF THE INVENTION

The present invention relates to a new and improved multiple longitudinal traversing shed weaving machine or loom containing a weaving rotor.

In its more particular aspects the present invention relates to a new and improved multiple longitudinal traversing shed weaving machine or loom containing a weaving rotor at which there are alternatingly arranged in respect of the direction of rotation of such weaving rotor beat-up combs formed by beat-up lamellae for beating-up the inserted weft threads and guide combs formed by guide lamellae for guiding of the warp threads and including shed-retaining elements for the upper shed position of the warp threads. Control means are arranged forwardly of the weaving rotor with respect to the running or travel direction of the warp threads and serve to laterally deflect and selectively allocate each warp thread to a respective one of the shed-retaining elements.

In a multiple longitudinal traversing shed weaving machine of this kind as known, for example, from U.S. Pat. No. 4,290,458, granted Sept. 21, 1981, the beat-up combs and the guide combs are mutually displaced by half a pitch or division of the lamellae. In conjunction with the control means for laterally deflecting the warp threads in the weft direction such structure ensures that each warp thread, when introduced into the desired tube of a lamellae comb, can be applied either from the left or from the right to the associate lamella in the lamellae comb which is in a preceding position in respect of the direction of rotation of the weaving rotor. Consequently, each warp thread is reliably introduced or threaded into the correct tube, whereby the warp introduction or threading errors which were known to previously occur in weaving rotors of multiple longitudinal traversing shed weaving machines and in rotary reeds of wave shed weaving machines could be avoided for the first time. This automatically resulted in an enlargement of the range of fields of application of multiple longitudinal traversing shed weaving machines by extending the same to larger warp densities than were usual up to that time.

When the warp density, however, exceeds a certain value, which is at about 30 to 40 warp threads per centimeter, warp introduction or threading errors can again occur and which are caused by warp threads skipping one tube and entering an adjacent incorrect tube.

SUMMARY OF THE INVENTION

Therefore, with the foregoing in mind it is a primary object of the present invention to provide an improved construction of a multiple longitudinal traversing shed weaving machine or loom which is not afflicted with the aforementioned drawbacks and limitations of the prior art constructions.

Another and more specific object of the present invention aims at the provision of a new and improved construction of a multiple longitudinal traversing shed weaving machine or loom in which introduction or threading errors for the warp threads are precluded even when working with larger warp densities.

Now in order to implement these and still further objects of the invention, which will become more readily apparent as the description proceeds, the weaving machine of the present development is manifested by the features that, each beat-up comb alternatingly contains first and second beat-up lamellae and each guide comb alternatingly contains first and second guide lamellae. Each of the second beat-up lamellae and guide lamellae, as compared to the first beat-up and guide lamellae, comprise a recess located at those locations of the lamellae combs which first immerse or dip into the warp threads during the rotary movement of the weaving rotor, and the lateral deflection of the warp threads by the control means reaches its maximum after the immersion of the first beat-up lamellae or guide lamellae.

Due to the recess at the aforementioned locations the tube into which the respective warp thread should be introduced is twice as wide, than in the absence of such recesses, at the moment when each lamellae comb immerses into the group of warp threads. There is thus ensured that each warp thread is reliably introduced into the double-width tube. During the subsequent period of time until the immersion of the second beat-up or guide lamellae provided with a recess the warp threads are still more intensively laterally deflected by the control means. During this deflection the warp threads are laterally engaged with the first beat-up or guide lamellae which define the tube of double width and which are already immersed in the group of warp threads. Consequently, the warp threads are positively guided into the tube which then has a normal width and are reliably introduced or threaded into the same when the second lamellae immerse or dip into the group of warp threads. The introduction or threading of the warp threads into the tube of double width may be additionally facilitated by arranging the beat-up and guide combs at a mutual offset in the manner as described in the aforementioned U.S. Pat. No. 4,290,458.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
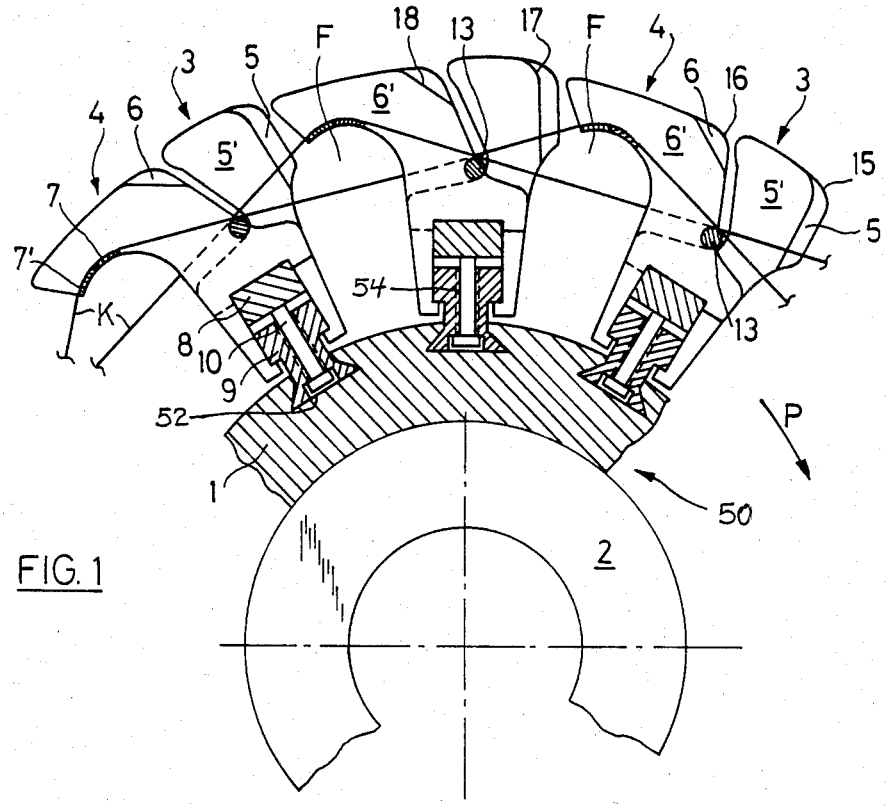
FIG. 1 shows a cross-section through a weaving rotor of a weaving machine or loom constructed according to the present invention.

Describing now the drawings, it is to be understood that only enough of the construction of the weaving machine or loom has been shown as needed for those skilled in the art to readily understand the underlying principles and concepts of the the present development, while simplifying the showing of the drawings. Turning attention now specifically to FIG. 1, there has been illustrated in cross-section therein a weaving rotor 50 of a multiple longitudinal traversing shed weaving machine or loom. The weaving rotor 50 comprises a hollow shaft 1 which extends across the width of the weaving machine. The hollow shaft 1 is supported at its end faces by tubular stubs or journals 2 which are mounted at the standard frame (not shown) of the weaving machine. During operation the weaving rotor 50 rotates in a predetermined direction of rotation which is indicated in FIG. 1 by arrow P. The construction and operation of a multiple longitudinal traversing shed weaving machine or loom containing a weaving rotor is properly assumed as well known to those skilled in the art and, therefore, is not here explained in any great detail; reference is, however, made in this regard to the aforementioned U.S. Pat. No. 4,290,458, the disclosure of which is incorporated by reference.

At the jacket or outer surface of the hollow shaft 1 there are arranged beat-up combs 3 and guide combs 4 which extend essentially parallel to the longitudinal axis of the hollow shaft 1. The beat-up combs 3 include first and second beat-up lamellae 5 and 5', respectively, for beating-up the inserted weft threads. The guide lamallae 4 include first and second guide lamellae 6 and 6', respectively, for the warp threads K.

During rotation of the weaving rotor 50 in the direction P the beat-up combs 3 and guide combs 4, i.e., these lamellae combs 3 and 4 first immerse or dip into the warp threads K with their corners 15 and 16, respectively, at the first beat-up lamellae 5 and the first guide lamellae 6, respectively. The respective second lamellae 5' and 6' differ from the respective first lamellae 5 and 6 by virtue of the fact that each comprise a respective recess 17 and 18 at those locations which first immerse or dip into the warp threads K. Such recesses 17 and 18 are formed by rearwardly offsetting the locations which first immerse into the warp threads K at the second lamellae 5' and 6' with respect to the corresponding locations 15 and 16 at the first lamellae 5 and 6, respectively, preferably by about 2 to 7 mm in respect of the direction of rotation P of the weaving rotor 50. As shown in the drawings, particularly FIG. 1 this is achieved by either bevelling the corresponding corner of the lamellae in the manner shown for the second guide lamellae 6' or by providing a smaller width for the lamellae in the manner shown for the second beat-up lamellae 5', whereby the front lamella edge is rearwardly displaced. At each one of the lamellae combs 3 and 4 the first and second beat-up lamellae 5 and 5' and the first and second guide lamellae 6 and 6', respectively, are alternatingly arranged.

The guide lamellae 6 and 6' are provided with shed-retaining elements for the upper shed position of the warp threads K. These shed-retaining elements are formed by laterally protruding projections 7 and 7' at the guide lamellae 6 and 6', resepectively. Each first guide lamella 6 is provided with a projection 7 and each second guide lamella 6' is provided with a projection 7'. The projections 7 and 7' protrude to different sides of the guide lamellae 6 and 6' and are offset with respect to each other in the warp direction. Within each guide comb 4 each tube, i.e. the intermediate space between adjacent guide lamellae 6 and 6', is alternatingly provided for the upper shed position or the lower or bottom shed position of the warp threads K. In each tube provided for the upper shed position the respective shed-retaining element is formed by two projections 7 and 7' which protrude towards each other. Due to the offset arrangement of the projections 7 and 7' in the warp direction the tube width may be adjusted therein between once and twice the value of the laterally protruding dimension of the projections or protuberances 7 and 7'.

Between each guide comb 4 and beat-up comb 3 there is provided, as seen in the direction of rotation P of the weaving rotor 50, a guide passage or channel F which is positioned at the location of maximum shed opening and which is upwardly defined or bounded by the projections 7 and 7'. The weft thread is inserted into the guide passage or channel F. Since in a multiple longitudinal traversing shed weaving machine containing the weaving rotor 50 as shown, in principle, any known kind of weft thread insertion technique can be employed like, for example, using gripper shuttles, projectiles, rapier grippers or air, and since the weaving rotor as shown is not limited to its use or specific for any particular mode of weft thread insertion, the weft thread insertion technique or method is not here explained in any great detail, particularly since the details thereof are unimportant in terms of the subject matter of the present invention. Reference is however made to U.S. Pat. application Ser. No. 06/463,022, filed Feb. 1, 1983, disclosing a particularly suitable weft thread insertion system using air, and the disclosure of which is incorporated herein by reference.

The first and the second beat-up lamellae 5 and 5' of the beat-up combs 3, on the one hand, and the first and the second guide lamellae 6 and 6' of the guide combs 4, on the other hand, are aligned with each other and the lines of alignment of the individual guide lamellae 6 and 6' extend through the center of the tube formed by the beat-up lamellae 5 and 5' and vice versa. Thus, the beat-up lamellae 5 and 5' of the beat-up combs 3 are arranged along first circumferential circles and the guide lamellae 6 and 6' of the guide combs 4 are arranged along second circumferential circles at the hollow shaft 1. The two types of circumferential circles are displaced from each other by half a pitch or division, i.e. half a tube width. Thus, corresponding first beat-up lamellae 5, corresponding second beat-up lamellae 5', corresponding first guide lamellae 6 and corresponding second guide lamellae 6' of all the lamella combs 3 and 4, respectively, are each located in common planes, i.e. are in alignment with each other. At its jacket or outer surface the hollow shaft 1 is provided with a number of dove-tail grooves 52 extending subtantially parallel to the axis of the hollow shaft 1 and corresponding in number to the number of guide passages or channels F. Each dove-tail groove 52 is intended to accommodate a common carrier or support for each one of the beat-up combs 3 and the guide combs 4.

Figure 2:
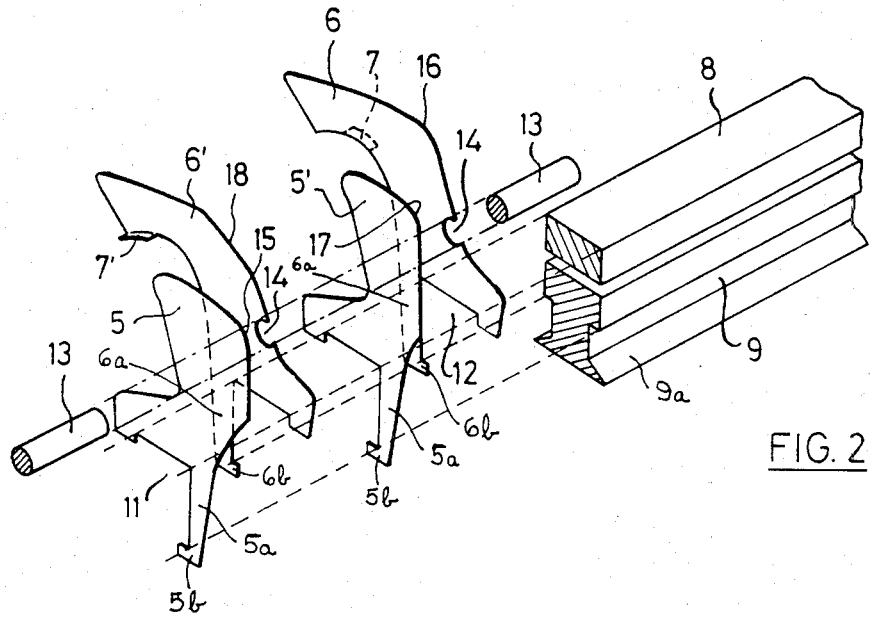
FIG. 2 is a schematic illustration in a perspective and exploded view of some lamellae and their support in the weaving rotor shown in FIG. 1.

According to the illustration in FIGS. 1 and 2 of the drawings, each carrier or support comprises two mutually parallel rails or rail members 8 and 9, the rail 9 being provided with a dove-tail *9a* corresponding to the aforementioned dove-tail groove 52. Each rail 9 is also provided with threaded bores 54 which are spaced along its length at a distance of about 5 to 10 cm. A countersunk screw or bolt 10 is threaded from below into each one of the threaded bores 54. These screws or bolts 10 protrude with one end thereof from the rail 9 and press against the other related rail 8. By rotating the threaded screws or bolts 10 the distance between the two rails or rail members 8 and 9 can be adjusted.

Each lamella 5 and 5' and 6 and 6' comprises two mounting legs or limbs *5a* and *6a*, respectively which surround a jaw or mouth 11 and 12, respectively, which partially extends around the rails 8, 9. The jaw or mouth 11 and 12 at each beat-up lamella 5 and 5' and at each guide lamella 6 and 6', respectively, is defined or bounded at the end of each mounting leg or limb *5a* and *6a* by a respective protrusion *5b* and *6b*. The protrusions or projections *5b* and *6b* are intended to snap about or engage with two diagonally opposed edges of the two rails 8 and 9. The width of each jaw or mouth 11 and 12 and the cross-section of the rails 8 and 9 are dimensioned such that, when the threaded screws or bolts 10 are loosened, i.e. when the two rails 8 and 9 are slightly spaced from each other, the beat-up lamellae 5 and 5' and the guide lamellae 6 and 6' can be pushed over the rails 8 and 9 with their respective mountng legs or limbs *5a* and *6a* and can be subsequently fixed by readjusting the threaded screws or bolts 10.

Each carrier or support formed by the rails 8 and 9 carries two lamellae combs 3 and 4 which are offset from each other by half a pitch or division or tube width, namely a beat-up comb 3 containing first beat-up lamellae 5 and second beat-up lamellae 5' and a guide comb 4 containing first guide lamellae 6 and second guide lamellae 6'. Each carrier or support is fixed in the related dove-tail groove or channel 52.

As will be evident from FIG. 1, the geometry of the lamellae combs 3 and 4 on the weaving rotor 50 is designed such that at any time when a warp thread K in the guide passages F alternatingly assumes the upper or lower shed position, and thus, is always tensioned between the projections 7 and 7' of a particular guide comb 4 and the second next or following guide comb 4, the intersection point of the groups of warp threads K is always located in the intermediate space formed between each beat-up comb 3 and each guide comb 4 of a lamellae comb pair supported at a common carrier or support. At large warp densities, i.e. with small spaces between the lamellae in the weft direction, such structure facilitates the shed changing movement of the warp threads K.

When the warp threads K wrap around the weaving rotor 50 in this manner and when additionally, as seen in the weft direction, the warp threads K always alternatingly assume the upper or lower shed position within each guide comb 4, such arrangement corresponds to a 1/1 weave or linen weave. In this case the warp threads K automatically assume the lower or bottom shed position in each second guide passage F since they are tensioned between the projections 7 and 7' of the different guide combs 4. For this type of weave there would thus not be required any special shed-retaining elements for the lower shed position.

In case of other weaves, i.e. in all those cases in which the warp threads K assume the lower shed position at lamellae comb pairs which follow each other in the direction of rotation P of the weaving rotor 50, shed-retaining elements are required for the lower or bottom shed position. As illustrated, such shed-retaining elements are formed by an elongate element 13 which forms a rod or tube and which extends essentially parallel to the lamellae combs 3 and 4. This element 13 is mounted at the location of the intersection point of the groups of warp threads K at each pair of lamellae combs 3 and 4. As illustrated, the guide lamellae 6 and 6' are each provided with a recess or groove 14 to hold the shed-retaining element 13 which preferably extends in one-piece over the entire length of the lamellae combs 3 and 4.

Figure 4:
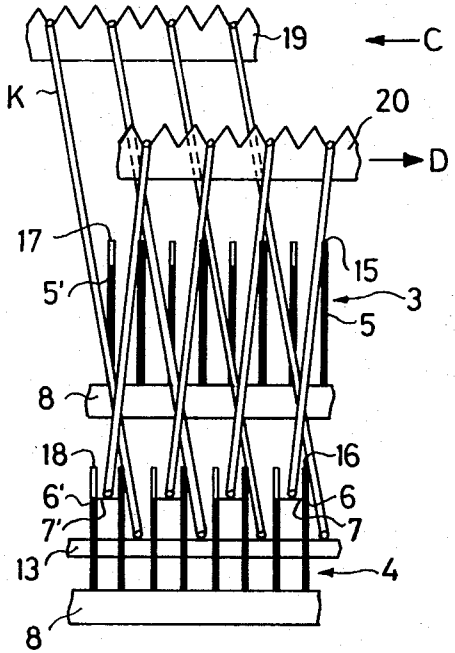
FIGS. 3 and 4 are respective schematic views of the weaving rotor shown in FIG. 1 and viewed in a direction opposite to the direction of the arrow P of FIG. 1 and serving to explain the function of the weaving rotor shown in such FIG. 1.
Figure 3:
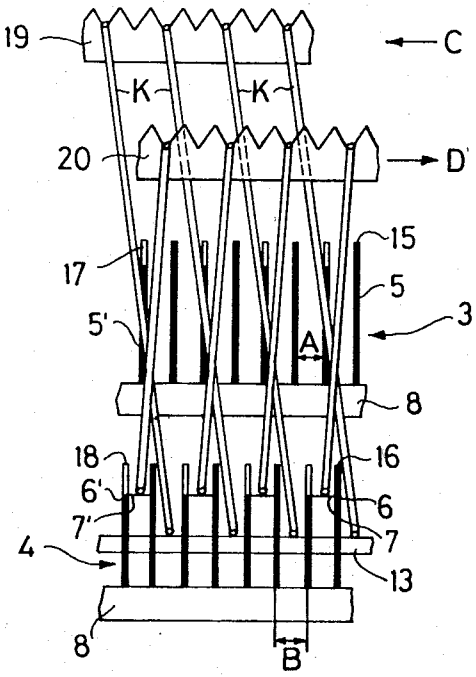

FIGS. 3 and 4 show a schematically illustrated development of a beat-up comb 3 and a guide comb 4 including the control means for laterally deflecting the warp threads K. In this development there is shown the introduction or threading of the warp threads K into the lamellae combs 3 and 4 and the function of the second beat-up lamellae 5' and the second guide lamellae 6' which are provided with the aforediscussed recesses 17 and 18, respectively. These two FIGS. 3 and 4 illustrate two different stages of the warp introduction or threading operation.

It will be seen that the two lamellae combs 3 and 4 including the first and second beat-up lamellae 5 and 5' and the first and second guide lamellae 6 and 6', respectively, are displaced from each other by half a pitch or division or tube width. One warp thread K is present in each tube formed by each one of the two lamellae combs.

The warp threads K are guided in shedding rods 19 and 20 which are arranged in front of the weaving rotor 50 as seen in the running or travel direction of the warp threads K. From the shedding rods 19, 20 the warp threads K extend to the lamellae combs 3 and 4. Each shedding rod 19, 20 guides warp threads K of the same weave, i.e. warp threads K which are commonly located in either the upper shed or the lower or bottom shed. The individual lamellae 5 and 5', 6 and 6' are each symbolized by a thick continuous line and the recesses 17 and 18 which are formed at each second beat-up lamella 5' and at each second guide lamella 6', respectively, are not continuously drawn, but are indicated by a free space enclosed by thin lines.

The guide comb 4 as illustrated and considered in FIGS. 3 and 4 is fully immersed into the warp threads K. In the drawing of FIG. 3 the beat-up comb 3 just starts its immersing or dipping movement. Due to the fact that each second beat-up lamella 5' is provided with a recess 17 or the like, the warp threads K do not have to be introduced into a tube A of normal width, but can be introduced into a tube 2A of double width in the first step of the immersion operation as illustrated in FIG. 3. The same is true for the immersion or dipping of the guide combs 4 with respect to the tubes B. It will be readily evident that the reliability with respect to the correct introduction or threading of the warp threads K is considerably increased due to the aforementioned tubes of double width.

For the first step of the warp introduction or threading operation as illustrated by FIG. 3, the shedding rods 19 and 20 which are of a rack-like design have been moved by their appropriate drive means such that the warp threads K assume the positions as shown. The warp threads K which are guided by the shedding rod 19 have been moved to the left, as indicated by the arrow C, and the warp threads K guided by the sheding rod 20 have been moved to the right, as indicated by the arrow D, during this operation and, in particular, each of the aforementioned warp threads K has been guided into a position where the same will be reliably introduced into the tubes having the double width 2A.

A certain period of time will elapse until now each second beat-up lamella 5' provided with a recess 17 or the like and located at the beat-up comb 3 also immerses or dips into the warp threads K. During this period of time the second step of the warp introduction or threading operation is conducted. During this second step, which is illustrated in FIG. 4, the shedding rods 19 and 20 are further displaced in the prior direction by the drive means until the warp threads K engage the first beat-up lamellae 5 which define the tube 2A of double width at the already immersed sections at the region of the locations 15 indicated in FIG. 1 and assume the position as depicted in FIG. 4. Subsequently a small further movement of the shedding rods 19 and 20 may occur in the prior direction, so that the warp threads K may safely engage the aforementioned first beat-up lamellae 5. During further immersion or dipping of the beat-up comb 3 the warp threads K slide along the first beat-up lamellae 5 and thus are positively introduced into the correct tube A, when the second beat-up lamellae 5' provided with the recesses 17 are immersed. Any incorrect warp introduction or threading is thus positively excluded. Prior to the immersion of the next following guide comb 4 the shedding rods 19 and 20 are moved opposite to the former or prior direction and thereafter the warp threads K are again introduced in the two-step manner as described hereinbefore.

The two steps in the introduction or threading of the warp threads K may also take place in a continuous process and merge with each other, however, they can also be carried out discontinuoulsy, i.e. in two steps which are separated from each other. It is essential that the warp introduction or threading is into a tube of double width in a pre-allocating or pre-sorting type of operation during the first step and subsequently into the final tube of normal width during a second step, the warp threads K being positively guided into the tube in the second step.

When not just one but, for example, two warp threads K would be present in each tube in contrast to the showing of FIGS. 3 and 4 and in correspondence to a double-stitch linen weave, then the two warp threads K could be guided in two different shedding rods. The two different shedding rods then would be oppositely moved, so that in the second step of the warp introduction the positive guidance as described hereinbefore is ensured at the lamellae defining or bounding the tube.

The invention is not limited to the illustrated arrangement of each two lamellae combs 3 and 4 being arranged on a common carrier or support. It will be self-evident that also each beat-up comb 3 and each guide comb 4 can be individually arranged as such at the hollow shaft 1 in any suitable manner. Equally, the shed-retaining element 13 shown in FIGS. 1 and 2 can assume any desired shape or configuration within wide limits. For example, the shed-retaining elements for the lower or bottom shed position also can be designed as projections formed at the beat-up or guide lamellae. However, in any case it is advantageous when the shed-retaining elements are arranged at the intersection point of the groups of warp threads K. The position of such intersection point may also vary and depends upon the selected geometry. The intersection point could also be located within the beat-up combs 3 or the guide combs 4. In such case the relevant beat-up or guide lamellae 5 or 6 would comprise an appropriate bore through which the shed-retaining element 13 would be pushed and piercingly extend. Instead of this design, the beat-up lamellae 5 or guide lamellae 6 could be provided at the corresponding location with projections serving as a shed-retaining element for the lower shed position of the warp threads.

It is also not necessarily required that the beat-up combs 3 and the guide combs 4 are displaced relative to each other by half a pitch or division, since up to a certain value of the warp density the introduction or threading of the warp threads into the tubes of double width is also possible without such an offset arrangement. However, the mutual offset of these combs has the advantage that already during the first step of the warp introduction or threading operation a kind of positive guidance for the warp threads is present in which the warp threads can be brought so as to laterally engage the lamellae which define or bound the tube in the already precedingly immmersed lamellae comb. If now the warp threads K would be already laterally deflected in the first step to such an extent that they will positively reach their final tube, the warp threads K could skip one tube and enter an incorrect adjacent tube when working with large warp densities. This danger is eliminated by the presence of the recess or the like at each second lamella, since then reliable introduction of the warp threads into a tube of double width is also ensured even with small lateral deflection of the warp threads.

While there are shown and described present preferred embodiments of the invention, it is to be distinctly understood that the invention is not limited thereto, but may be otherwise variously embodied and practiced within the scope of the following claims. Accordingly,

What I claim is:

1. A multiple longitudinal traversing shed weaving machine comprising:

a weaving rotor rotatable in a predetermined direction of rotation;

beat-up combs and guide combs arranged at said weaving rotor in alternating fashion in respect of said direction of rotation of said weaving rotor;

each said beat-up comb defining a lamella comb containing in an alternating arrangement first and second lamellae for beating-up weft threads inserted through warp threads;

each said guide comb defining a lamellae comb containing in an alternating arrangement first and second guide lamellae for said warp threads and shed-retaining elements defining an upper shed position of said warp threads;

said second beat-up lamellae and said second guide lamellae, in comparison to said first beat-up lamellae and said first guide lamellae, each being provided with a recess;

said recesses being located at those locations at said lamellae combs which first immerse into said warp threads when said weaving rotor is rotated in said predetermined direction of rotation;

control means arranged forwardly of said weaving rotor relative to a predetermined direction of travel of said warp threads for laterally deflecting said warp threads and selectively allocating each one of said warp threads to a respective one of said shed-retaining elements; and said control means providing maximum lateral deflection of said warp threads after either said first beat-up lamellae or said first guide lamellae have been immersed into said warp threads.

2. The weaving machine as defined in claim 1, wherein:

said beat-up combs define first beat-up combs each of which contains said second beat-up lamellae;

each said second beat-up lamellae comprises a recess formed by a front edge thereof which is rearwardly offset in respect of said predetermined direction of rotation of said weaving rotor; and each said recess at said second guide lamellae of each said guide comb being formed by a bevelled portion.

3. The weaving machine as defined in claim 1, wherein:

each said recess has a depth amounting to several millimeters.

4. The weaving machine as defined in claim 3, wherein:

said depth of said recess lies in a range of approximately 2 to 7 mm.

5. The weaving machine as defined in claim 3, wherein:

each said recess at said second guide lamellae is formed by a bevelled portion at said location first immersing into said warp threads.

6. The weaving machine as defined in claim 3, wherein:

each said second beat-up lamella defines a frontmost edge in respect of said predetermined direction of rotation of said weaving rotor; and said recess of each said second beat-up lamella being formed by rearwardly offsetting said frontmost edge.

7. The weaving machine as defined in claim 3, wherein:

said weaving rotor defines a longitudinal axis;

said second beat-up lamellae at all said beat-up combs are essentially in alignment with one another; and said second beat-up lamellae at all said beat-up combs are arranged in respective common planes extending transversely relative to said longitudinal axis of said weaving rotor.

8. The weaving machine as defined in claim 7 wherein:

said second guide lamellae at all said guide combs are essentially in alignment with one another; and said second guide lamellae at all said guide combs are arranged in respective common planes extending transversely relative to said longitudinal axis of said weaving rotor.

9. The weaving machine as defined in claim 8, wherein:

said beat-up combs and said guide combs each define a respective pitch;

said common planes defined by said second beat-up lamellae at said beat-up combs and said common planes defined by said second guide lamellae at said guide combs are mutually offset; and said mutual offset amounts to a fraction of said pitch.

10. The weaving machine as defined in claim 9, wherein:

said mutual offset amounts to half said pitch.

11. The weaving machine as defined in claim 3, wherein:

said second beat-up lamellae and said second guide lamellae are immersible into the warp threads after said first beat-up lamellae and said first guide lamellae, respectively; and said control means controlling said lateral deflection of said warp threads such that said warp threads laterally engage either said first beat-up lamellae or said first guide lamellae after immersion of the same and prior to the immersion of said second beat-up lamellae or said second guide lamellae.

12. The weaving machine as defined in claim 11, wherein:

said control means subject said warp threads to an additional lateral deflection after their lateral engagement with either said first beat-up lamellae or said first guide lamellae.

* * * * *

UNITED STATES PATENT AND TRADEMARK OFFICE

CERTIFICATE OF CORRECTION

PATENT NO. : 4,498,501

DATED : February 12, 1985

INVENTOR(S) : ALOIS STEINER

It is certified that error appears in the above-identified patent and that said Letters Patent is hereby corrected as shown below:

Column 5, line 1, please delete "subtantially" and insert --substantially--

Column 5, line 36, please delete "mountng" and insert --mounting--

Column 7, line 44, please delete "discontinuoulsy" and insert --discontinuously--

Signed and Sealed this

*Eighteenth* Day of *June 1985*

[SEAL]

*Attest:*

DONALD J. QUIGG

*Attesting Officer* *Acting Commissioner of Patents and Trademarks*